US007476305B2

(12) United States Patent
Chopra

(10) Patent No.: US 7,476,305 B2
(45) Date of Patent: Jan. 13, 2009

(54) RECOVERY SYSTEM FOR PLATINUM PLATING BATH

(75) Inventor: Dinesh Chopra, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 716 days.

(21) Appl. No.: 10/382,871

(22) Filed: Mar. 7, 2003

(65) Prior Publication Data

US 2003/0164291 A1 Sep. 4, 2003

Related U.S. Application Data

(62) Division of application No. 09/921,781, filed on Aug. 6, 2001, now Pat. No. 6,616,828.

(51) Int. Cl.
*C25D 21/18* (2006.01)

(52) U.S. Cl. ..... 204/237; 204/238; 210/758; 210/759

(58) Field of Classification Search ..... 204/238; 210/758, 759, 760
See application file for complete search history.

(56) References Cited

U.S. PATENT DOCUMENTS 4,696,717 A * 9/1987 Bissinger ..... 216/93
4,853,380 A * 8/1989 Schwartz ..... 514/184

FOREIGN PATENT DOCUMENTS

EP 465073 A1 6/1991

OTHER PUBLICATIONS

Smith et al, Principles and Practice of Automatic Process Control, Chpater 6: Design of Single-LoppFeedback Control Systems 1997, pub. by John Wiley & Sons, pp. 252-302.*

* cited by examiner

*Primary Examiner*—Harry D Wilkins, III
(74) *Attorney, Agent, or Firm*—Dickstein Shapiro LLP

(57) ABSTRACT

A recovery system for platinum electrolytic baths operating at low current densities is disclosed. An oxidizing system is provided in a closed-loop recirculation system for platinum plating at low current densities. The oxidizing system reoxidizes $Pt^{+2}$ ions, which are typically formed at low current densities, to $Pt^{+4}$ ions by using oxidizers, for example peroxide. A sensor may be also provided to detect the relative concentration of $[Pt^{+2}]$ ions to $[Pt^{+4}]$ ions and to tailor the relative concentrations to a predetermined level.

26 Claims, 3 Drawing Sheets

RECOVERY SYSTEM FOR PLATINUM PLATING BATH

This application is a divisional of application Ser. No. 09/921,781, filed on Aug. 6, 2001, now U.S Pat. No. 6,616, 828, which is hereby incorporated by reference.

FIELD OF THE INVENTION

The present invention relates to the field of electrochemical deposition and, in particular, to a novel method for platinum (Pt) electroplating.

BACKGROUND OF THE INVENTION

Platinum (Pt) has become an attractive material for use in integrated circuits because of its desirable chemical and mechanical properties, having a very low reactivity and being inert to oxidation. Platinum also has a low leakage current and a high electrical conductivity. Further, platinum is known to have a notably high work function. The work function is an important feature of a DRAM capacitor electrode material and, when quantified, it denotes the energy required to remove one electron from the metal. Advanced DRAM capacitors are characterized by a dominant leakage mechanism, known as the Schottky emission from metal into the dielectric, so that metals, like platinum, with high work function produce less leakage.

Deposition of a metal layer generally occurs through one of the following techniques: chemical vapor deposition (CVD); physical vapor deposition (PVD), also known as sputtering; or electrochemical deposition. CVD involves high temperatures which can lead to cold creep effects and an increased chance of impurity contamination over other methods, and sputtering has problems yielding sufficient step coverage and density at small line widths. Electrochemical deposition, however, offers a more controlled environment to reduce the chance of contamination, and a process that takes place with minor temperature fluctuations. Electrochemical deposition provides more thorough coverage, fewer physical flaws, and reduces separation between the layers.

There are several known electrochemical deposition processes used to form platinum interconnects and/or capacitor structures, for example capacitor electrodes. Electroplating of platinum onto a substrate is now a common practice in the manufacture of various platinum interconnect and/or capacitor electrodes. Such an electroless plating bath typically includes (1) water; (2) a soluble compound containing platinum to be deposited onto the substrate of interest; (3) a complexing agent for the corresponding platinum ions, which prevents chemical reduction of the platinum ions in solution while permitting selective chemical reduction on a surface of the substrate; (4) a chemical reducing agent for the platinum ions; (5) a buffer for controlling the pH; and (6) small amounts of additives, such as surfactants or stabilizers.

A disadvantage of the platinum plating bath described above is that conformal plating of a platinum electrode of a container capacitor, for example, requires low current densities for platinum plating. However, at low current densities, platinum $Pt^{+4}$ ions get converted into $Pt^{+2}$ ions which do not plate out. As a result, the converted $Pt^{+2}$ ions remain in the plating solution and dissociate into platinum when current is passed thorough the solution. To remedy this drawback, plating at higher current densities has been proposed, but this deposition is not suitable for capacitor applications, such as electrode formation.

There is needed, therefore, a simple and inexpensive method of operating a plating bath at low current densities and without degrading the plating bath.

BRIEF SUMMARY OF THE INVENTION

The present invention provides a recovery system for platinum electrolytic baths at low current densities. An oxidizing tower is provided in a closed-loop recirculation system for platinum plating at low current densities. The oxidizing tower reoxidizes $Pt^{+2}$ ions, which are typically formed at low current densities, to $Pt^{+4}$ ions by using oxidizers, for example peroxide. This way, the platinum electrolytic bath is replenished in-situ and the platinum bath is not degraded. A sensor may be also provided to detect the relative concentration of $[Pt^{+2}]$ ions to $[Pt^{+4}]$ ions and operate the oxidation tower to tailor such ratio at a predetermined level.

Additional advantages and features of the present invention will be apparent from the following detailed description and drawings which illustrate preferred embodiments of the invention.

DETAILED DESCRIPTION OF THE INVENTION

In the following detailed description, reference is made to various specific embodiments in which the invention may be practiced. These embodiments are described with sufficient detail to enable those skilled in the art to practice the invention, and it is to be understood that other embodiments may be employed, and that structural, logical, and electrical changes may be made without departing from the spirit or scope of the invention.

The term "substrate" used in the following description may include any semiconductor-based structure. Structure must be understood to include silicon, silicon-on insulator (SOI), silicon-on sapphire (SOS), doped and undoped semiconductors, epitaxial layers of silicon supported by a base semiconductor foundation, and other semiconductor structures. The semiconductor also need not be silicon-based. The semiconductor could be silicon-germanium, germanium, or gallium arsenide. When reference is made to a substrate in the following description, previous process steps may have been utilized to form regions or junctions in or on the base semiconductor or foundation.

The term "platinum" is intended to include not only elemental platinum, but platinum with other trace metals or in various alloyed combinations with other metals as known in the semiconductor art, as long as such platinum alloy is conductive.

The present invention provides a recovery system for platinum electrolytic plating baths at low current densities. According to a preferred embodiment of the invention, platinum films are formed in an electrolytic platinum bath provided in a close-loop recirculation system including an oxidizing tower for converting $Pt^{+2}$ ions to $Pt^{+4}$ ions.

Figure 1:
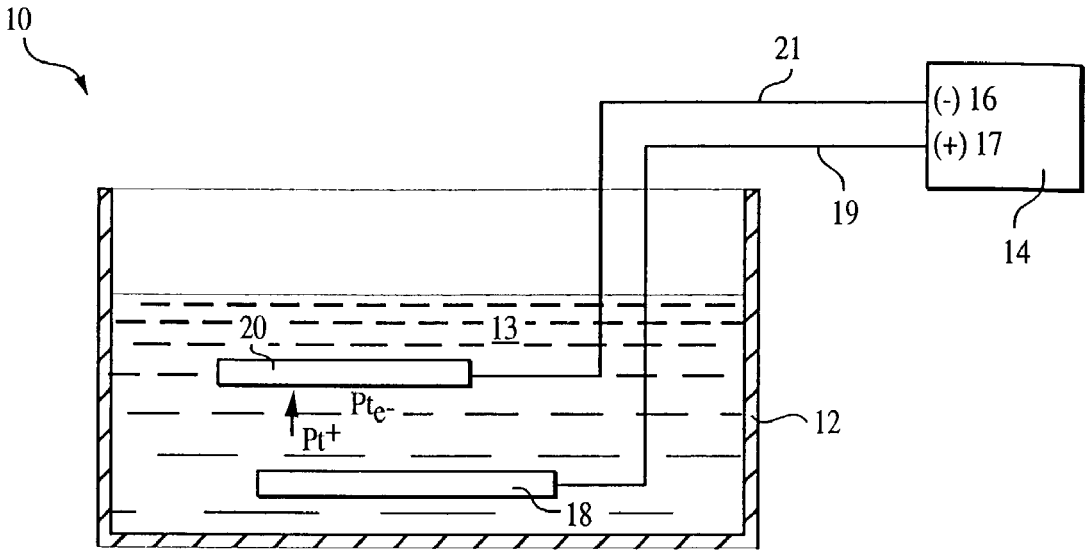
FIG. 1 illustrates a schematic view of an electroplating bath used in a plating bath recovery system formed according to the present invention.

Referring now to the drawings, where like elements are designated by like reference numerals, FIGS. 1-4 illustrate embodiments of a recirculation system 11 (FIG. 2) for platinum plating baths formed according to the present invention. FIG. 1 depicts a schematic view of an electrolytic plating bath 10 of a plating chamber 34 which is part of the recirculation system 11 (FIG. 2) constructed in accordance with a method of the present invention. As depicted in FIG. 1, the electrolytic plating bath 10 includes a tank 12 confining an electrolytic solution 13 in which an object (cathode) 20 that is to be plated is immersed. The object (cathode) 20 may be any substrate on which platinum deposition is desirable, such as a semiconductor wafer or an integrated printed circuit board, among many others.

A plating DC voltage source 14 (FIG. 1) has a negative terminal 16 connected via a lead 21 to the object (cathode) 20 that is to be plated. A positive terminal 17 of the voltage source 14 is connected via a lead 19 to the anode 18, as also illustrated in FIG. 1. As known in the art, an electric potential is established between the anode 18 and the object (cathode) 20 so that the circuit established between the anode and the cathode results in a current density with current lines of force. The concentration of current lines of force is directly related to the amount of metal deposited on the object (cathode) 20. Although FIG. 1 illustrates the object (cathode) 20 that is to be plated as being totally immersed in the electrolytic solution 13, it must be understood that the object (cathode) 20 may be also partially immersed, according to the device characteristics of each particular application. Also, although FIG. 1 illustrates only one object (cathode) 20, it must be understood that any number of objects 20, for example a plurality of semiconductor wafers, may be processed simultaneously by using a large bath, thereby reducing the cost of manufacture.

According to an embodiment of the invention, the electrolytic solution 13 (FIG. 1) is an alkaline electroplating bath. In a preferred embodiment, the electrolytic solution 13 comprises a salt, preferably hexahydroxy-platinate $[H_2Pt(OH)_6]$, in conjunction with a base, for example potassium hydroxide (KOH), sodium hydroxide (NaOH), sodium carbonate ($Na_2CO_3$), or tetramethyl ammonium hydroxide (TMAH), among others. The base acts as a pH controlling agent for the electrolytic solution 13, so that the pH of the electrolytic solution 13 is maintained at a value of about 9 to about 12 in order for the electroplating deposition reaction to be initiated. The hexahydroxy-platinate $[H_2Pt(OH)_6]$ electrolytic solution is maintained at a temperature of about 45° C. to about 75° C., more preferably of about 65° C. In an exemplary embodiment of the invention, the object (cathode) 20 is partially immersed in the hexahydroxy-platinate $[H_2Pt(OH)_6]$ electrolytic solution for about 2 minutes to about 4 minutes, more preferably for about 3 minutes.

As known in the art, the electrolytic solution 13 (FIG. 1) permits the formation of a thick platinum layer (not shown) on the object (cathode) 20 because electrons are continuously replaced by the electric current applied and, therefore, the platinum ions from the anode 18 which have an electron affinity may continuously plate the object (cathode) 20. The dissociation of the hexahydroxy-platinate in the presence of electric current is exemplified in equations (1) and (2):

$$[H_2Pt(OH)_6] \rightarrow Pt + H_2O \quad (1)$$

$$Pt^{+4} + 4e^- \rightarrow Pt^0 \quad (2)$$

If desired, the tank 12 (FIG. 1) may be provided with a cascade structure (not shown) to ensure that fresh solution is made available to the object (cathode) 20. Other suitable means, such as a diffuser or baffle plate, for agitating and/or flowing the electrolytic solution 13 against the object (cathode) 20 may be also employed, as desired. Further, the electrolytic solution 13 may comprise various organic and/or inorganic additives, such as brighteners, levelers, surfactants, exaltants, suppressors, among others, according to the desired performance characteristics of the electroplating bath.

Figure 2:
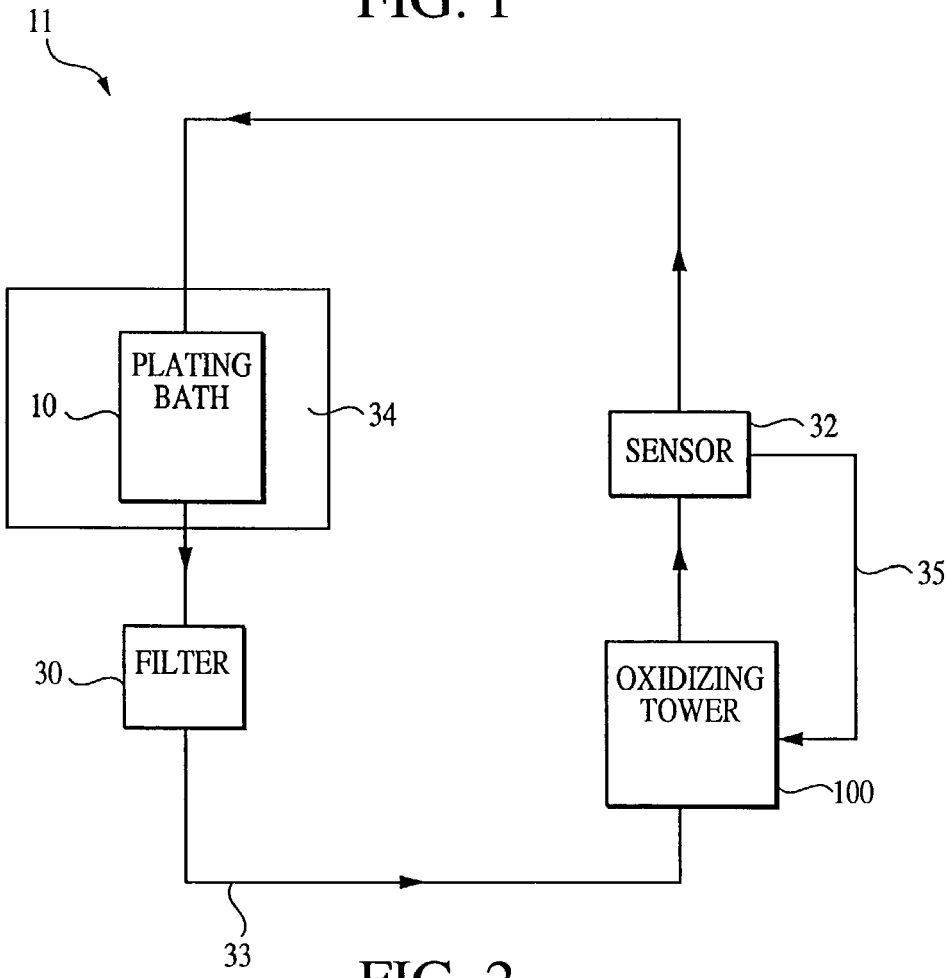
FIG. 2 illustrates a schematic view of a plating bath recovery system formed according to the present invention.

As explained above, at low current densities, for example at a current density of less than 5 $mA/cm^2$, and at a temperature of about 60° C. to about 65° C., $Pt^{+2}$ ions also form from $Pt^{+4}$, along with the formation of $Pt^0$ from $Pt^{+4}$, as depicted by equation (2). In contrast to $Pt^{+4}$ ions, $Pt^{+2}$ ions do not form $Pt^0$ but instead they remain on, and stick to, the object (cathode) 20 forming a black and flaky residue on the object (cathode) 20. According to the present invention, an oxidizing tower 100 (FIG. 2) and, if desired, a sensor 32 (FIG. 2) are coupled to the electrolytic plating bath 10 (FIGS. 1-2) so that the conversion of $Pt^{+2}$ ions to $Pt^{+4}$ takes place to eliminate the black, flaky residue formed by $Pt^{+2}$ ions on the object (cathode) 20. For a better understanding of the invention, FIG. 3 illustrates only a partial view of the recirculation system 11 of FIG. 2, depicting only the oxidizing tower 100, the filter 30, the plating bath 10 and the sensor 32.

Figure 3:
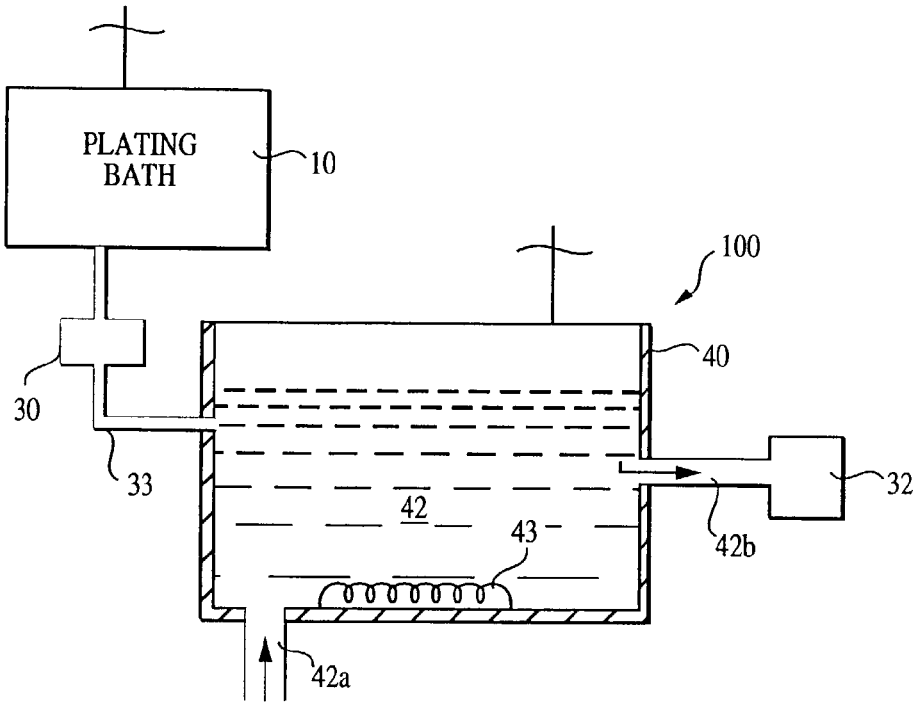
FIG. 3 illustrates a schematic view of an electroplating chamber connected to an oxidizing tower used in a plating bath recovery system formed according to a first embodiment of the present invention.

As shown in FIG. 3, the oxidizing tower 100 comprises an oxidizing tank 40 provided with two conduits (openings) **42*a* and 42*b* through which an oxidizing solution 42 is supplied in and out of the oxidizing tank 40. The oxidizing tower 100 is connected to the electrolytic plating bath 10 by a feed conduit 33 (FIG. 3), which allows a part, or all, of the decomposed platinum electrolytic solution 13 containing $Pt^{+2}$ ions to be fed to the oxidizing tank 40. In a preferred embodiment of the invention, a percentage, for example about 5-15% of the decomposed platinum electrolytic solution 13, and more preferably about 10% of the decomposed platinum electrolytic solution 13, is fed through the feed conduit 33 into the oxidizing tank 40**.

The percentage of the decomposed platinum electrolytic solution 13 is fed through the feed conduit 33 at a feed rate of about 1 to 5 L/min, more preferably at a rate of about 2 L/min. The feed rate depends, however, on other parameters, such as the volume of the oxidizing tank 40 as well as the concentration of the incoming percentage of the decomposed platinum electrolytic solution 13. In any event, the percentage of the decomposed platinum electrolytic solution 13 containing $Pt^{+2}$ ions may be continuously fed, for example by a Continuous Stirred Tank Reaction (CSTR) known in the art, or may be supplied by a batch reaction, according to which predetermined amounts of electrolytic solution are fed into the oxidizing tank 40 at various predefined time intervals.

In a preferred embodiment, the oxidizing tower 100 contains an oxidizing solution 42 (FIG. 3) comprising about 30% peroxide ($H_2O_2$) at a temperature of about 60° C. to about 80° C., more preferably at about 65° C., which is maintained by using heating element 43, also shown in FIG. 3. Although peroxide is preferred, other oxidizing agents known in the art, such as ferric nitrite ($FeNO_3$) or potassium permanganite ($KMnO_4$) may be used also, as desired. The oxidizing agent is fed into the oxidizing tower 100 at either regular intervals or constantly, depending on whether batch processing or CSTR flow is employed, and as desired.

Referring back to FIG. 2, the percentage of the decomposed platinum electrolytic solution 13 containing $Pt^{+2}$ ions exits the electrolytic plating bath 10, passes through filter 30, which may be a 0.2μ filter, and is then bubbled, for example, to reach the oxidizing tower 100 through the feed conduit 33. As mentioned above, a continuous reaction or a batch reaction may be used to supply the percentage of the decomposed platinum electrolytic solution 13 to the oxidizing tank 40 containing the peroxide oxidizing solution 42.

If batch processing is employed, a predetermined amount of platinum electrolytic solution 13 containing $Pt^{+2}$ ions is fed into the oxidizing tower 100 which contains about 30% peroxide ($H_2O_2$) solution. The mixture of the predetermined amount of $Pt^{+2}$ platinum electrolytic solution and of about 30% peroxide is constantly heated, at about 65° C., by using the heating element 43. Once the $Pt^{+2}$ ions of the percentage of the decomposed platinum electrolytic solution 13 reach the peroxide oxidizing solution 42, the $Pt^{+2}$ ions are converted and reoxidized to $Pt^{+4}$ ions according to the following reaction:

$$H_2O_2+Pt^{+2}\rightarrow Pt^{+4}+2e^{31} \quad (3)$$

By constantly heating the mixture at about 65° C., the $Pt^{+2}$ ions are converted and reoxidized to $Pt^{+4}$ ions in accordance to equation (3) above, and the peroxide ($H_2O_2$) solution of the mixture is also boiled off. This way, with the peroxide solution boiled off, the remaining of the mixture is sent through the conduit 42*b* (FIG. 3) to the sensor 32 to evaluate the ratio of $[Pt^{+2}]/[Pt^{+4}]$ concentrations, as well as the concentration of any remaining peroxide ($H_2O_2$).

Figure 4:
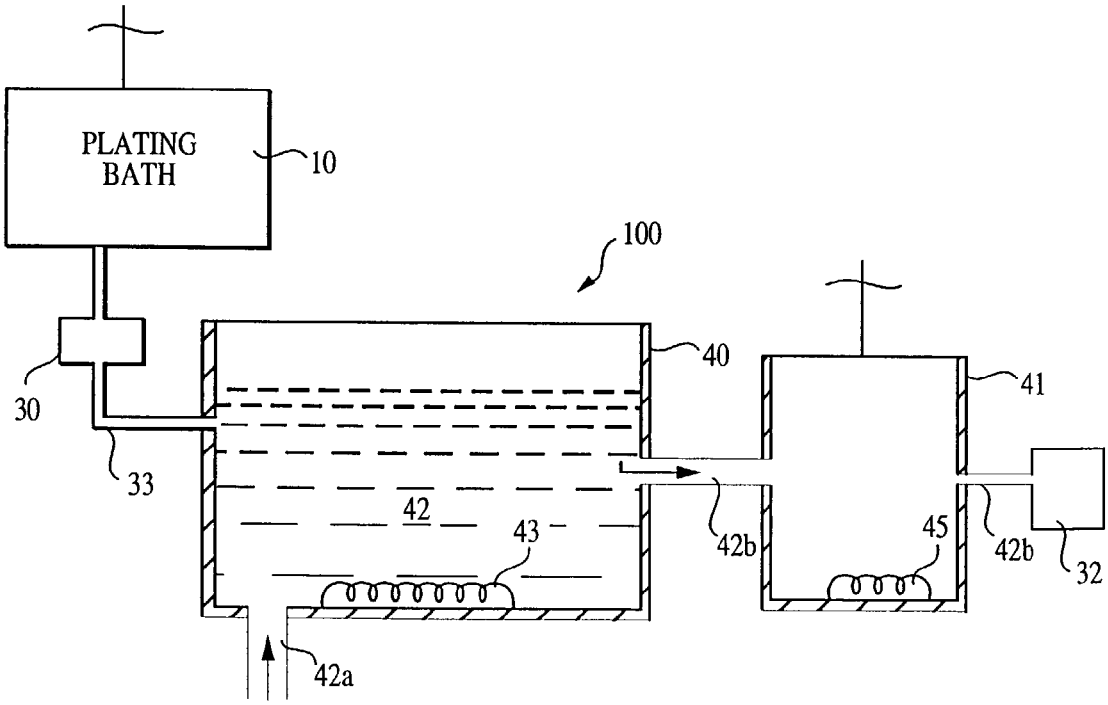
FIG. 4 illustrates a schematic view of an electroplating chamber connected to an oxidizing tower used in a plating bath recovery system formed according to a second embodiment of the present invention.

According to another embodiment of the invention and if a Continuous Stirred Tank Reaction (CSTR) is employed, the platinum electrolytic solution 13 containing $Pt^{+2}$ ions is continuously fed at about 2 L/min into the oxidizing tower 100 which contains about 30% peroxide ($H_2O_2$) solution. As in the batch processing, the mixture of the predetermined amount of $Pt^{+2}$ platinum electrolytic solution and of about 30% peroxide is constantly heated, at about 65° C., by using the heating element 43. Once the $Pt^{+2}$ ions of the percentage of the decomposed platinum electrolytic solution 13 reach the peroxide oxidizing solution 42, the $Pt^{+2}$ ions are converted and reoxidized to $Pt^{+4}$ ions according to the equation (3) above. The peroxide ($H_2O_2$) solution is also boiled off; however, because the flow of the platinum electrolytic solution 13 and/or of the peroxide ($H_2O_2$) solution in the oxidizing tower 100 is constant, the peroxide ($H_2O_2$) solution cannot be completely boiled off in the oxidizing tower 100. Thus, the remaining of the mixture comprising $Pt^{+4}$ ions and any non-vaporized peroxide ($H_2O_2$) solution is sent through the conduit 42*b* to another oxidizing tower or reactor 41 (FIG. 4) which is provided with another heating element 45 (FIG. 4). The reactor 41 is heated by the heating element 45 to boil off any of the remaining peroxide ($H_2O_2$) solution. With all the peroxide solution boiled off, the remaining of the mixture is sent through the conduit 42*b* to the sensor 32 to evaluate the ratio of $[Pt^{+2}]/[Pt^{+4}]$ concentrations as well as the concentration of any remaining peroxide ($H_2O_2$).

The sensor 32 (FIG. 2) provides a signal to the oxidizing tower 100 through the feedback loop 35 (FIG. 2) to optimize the flow rate and the residence time of the percentage of the decomposed platinum electrolytic solution 13 containing $Pt^{+2}$ ions in the oxidizing tank 40. In an exemplary embodiment of the present invention, the sensor 32 is a simple sensor able to detect the concentrations of the $[Pt^{+4}]$, $[Pt^{+2}]$ and $[H_2O_2]$ and to identify the peaks corresponding to the respective concentrations. For example, the sensor 32 may be a galvanic cell with cyclic voltammetry which is able to scan the voltage and to detect the peaks of $[Pt^{+4}]$, $[Pt^{+2}]$, and $[H_2O_2]$ concentrations.

The sensor 32 also monitors the ratio of $[Pt^{+2}]/[Pt^{+4}]$ and, therefore, the amount of reoxidation that takes place in the oxidizing tower 40 and/or reactor 41. Of course, it is desirable that the value of the $[Pt^{+2}]$ concentration, as well as the ratio $[Pt^{+2}]/[Pt^{+4}]$, be as minimal as possible so that the value of the $[Pt^{+4}]$ concentration be maximized. By detecting the ratio $[Pt^{+2}]/[Pt^{+4}]$, the sensor 32 is able to allow the oxidizing tower 100 to maintain such ratio to a certain, predefined level. The sensor 32 also monitors the $[H_2O_2]$ concentration to ensure that all $H_2O_2$ is removed before transferring the oxidized solution to the plating bath. All this information is further used to optimize the flow rates of platinum, $H_2O_2$ and/or residence times in the oxidizing tower. This way, $Pt^{+2}$ ions are reoxidized and recovered in-situ so that no flaky, black residue, which characterizes conventional low current density electroplating methods, forms on the object (cathode) 20 that is to be plated. Once the concentration of the $Pt^{+2}$ ions is diminished to the predefined desired concentration, which is preferably zero, the percentage of the platinum electrolytic solution 13 becomes a reoxidized platinum electrolytic solution which reaches the plating chamber 34 (FIG. 2) back to the electrolytic plating bath 10. This way, the platinum electrolytic solution 13 is replenished in-situ and the electroplating process continues without the formation of the $Pt^{+2}$ residue.

The electroplating method of the present invention is useful for depositing platinum films with good step coverage onto the surface of any substrate, particularly onto surfaces of integrated circuits. For example, platinum films with good step coverage may be formed according to the present invention onto borophosphosilicate (BPSG), silicon, polysilica glass (PSG), titanium, oxides, polysilicon or silicides, among others. The invention is further explained with reference to the formation of a platinum electrode, for example an upper capacitor plate or upper electrode, of a metal-insulator-metal (MIM) capacitor.

Although the present invention will be described below with reference to a metal-insulator-metal (MIM) capacitor (FIGS. 5-6) that has an upper capacitor plate 77 (FIG. 6) formed by platinum plating using the in-situ recovery electroplating system outlined above, it must be understood that the present invention is not limited to MIM capacitors having a platinum upper capacitor plate, but it also covers other capacitor structures, such as, for example, conventional capacitors or metal-insulator-semiconductor (MIS) capacitors used in the fabrication of various IC memory cells, as long as one or both of the capacitor plates are formed by platinum plating using the in-situ recovery electroplating system having an oxidizing tower according to the present invention.

Figure 5:
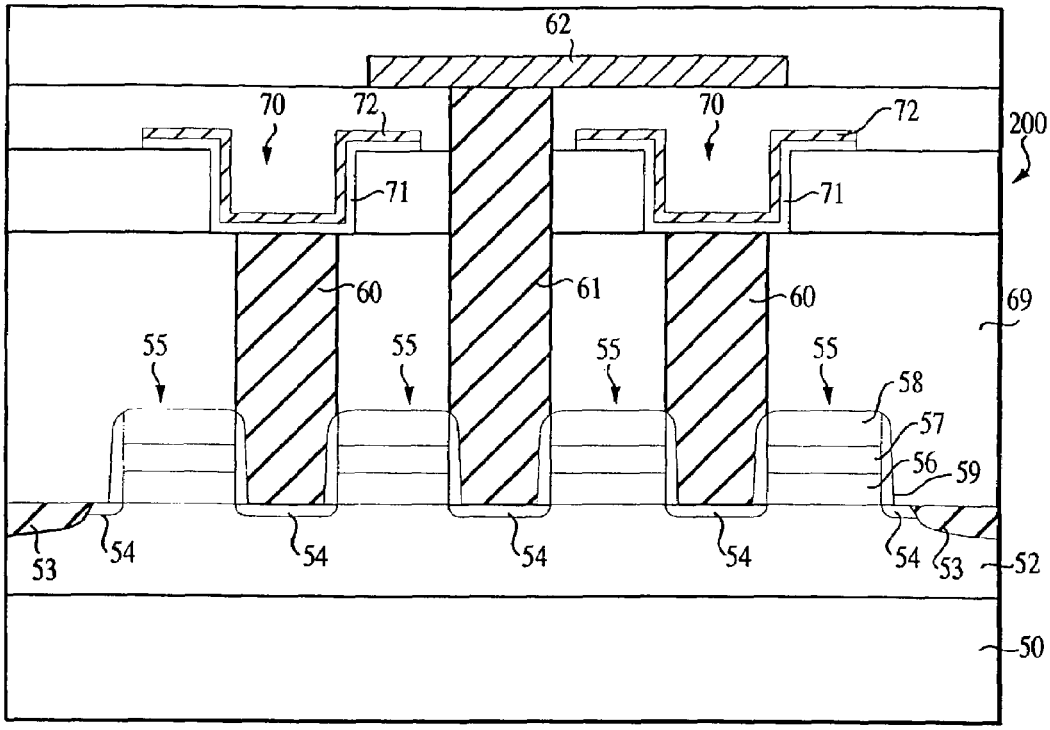
FIG. 5 PRIOR ART
FIG. 5 illustrates a schematic cross-sectional view of a portion of a memory device formed according to the method of the present invention.

Referring now to the drawings, FIG. 5 shows a portion 200 of a conventional DRAM memory at an intermediate stage of the fabrication. A pair of memory cells having respective access transistors are formed on a substrate 50 having a doped well 52, which is typically doped to a predetermined conductivity, e.g. P-type or N-type depending on whether NMOS or PMOS transistors will be formed. The structure further includes field oxide regions 53, conventional doped active areas 54, and a pair of gate stacks 55, all formed according to well-known semiconductor processing techniques. The gate stacks 55 include an oxide layer 56, a conductive gate layer 57, spacers 59 formed of an oxide or a nitride, and a cap 58 which can be formed of an oxide, an oxide/nitride, or a nitride.

The conductive gate layer 57 could be formed, for example, of a layer of doped polysilicon, or a multi-layer structure of polysilicon/$WSi_x$, polysilicon/$WN_x$/W or polysilicon/$TiSi_2$.

Further illustrated in FIG. 5 are two MIM capacitors 70, at an intermediate stage of fabrication and formed in an insulating layer 69, which are connected to active areas 54 by two respective conductive plugs 60. The DRAM memory cells also include a bit line contact 62, which is further connected to the common active area 54 of the access transistors by another conductive plug 61. The access transistors respectively write charge into and read charge from capacitors 70, to and from the bit line contact 62.

The processing steps for the fabrication of the MIM capacitor 70 (FIG. 5) provided in the insulating layer 69 include a first-level metallization 71, a dielectric film deposition 72, and a second-level metallization. For example, FIG. 5 illustrates the MIM capacitor 70 after formation of the dielectric film 72. As such, a lower capacitor plate 71, also called a bottom or lower electrode, has already been formed during the first-level metallization. The material for the lower capacitor plate 71 is typically selected from the group of metals, or metal compositions and alloys, including but not limited to osmium (Os), platinum (Pt), rhodium (Rh), ruthenium (Ru), palladium (Pd), iridium (Ir), and their alloys.

Following the first-level deposition, the first level metallization is removed from the top surface regions typically by resist coat and CMP or dry etch. A high dielectric film 72 (FIG. 5) is formed over the lower capacitor plate 71. The most common high dielectric material used in MIM capacitors is tantalum oxide ($Ta_2O_5$), but other materials such as silicon dioxide ($SiO_2$), silicon nitride ($Si_3N_4$), strontium titanate ($SrTiO_3$), alumina ($Al_2O_3$), barium strontium titanate ($BaSrTiO_3$), or zirconium oxide ($ZrO_2$) may also be used. Further, perovskite oxide dielectric films of the paraelectric type, such as lead titanate ($PbTiO_3$) or lead zirconite ($PbZrO_3$), are also good candidates for high dielectric film materials even if their dielectric constant is slightly lower than that of the above mentioned dielectrics. As known in the art, the thickness of the high dielectric film 72 determines the capacitance per unit area of the MIM capacitor 70.

After the formation of the dielectric film 72 (FIG. 5), a second-level metallization is performed during which a platinum layer 77 (FIG. 6) is formed by the low current density electroplating method described in detail above, to complete the formation of the MIM capacitor 70. Accordingly, the substrate 50 is introduced into the tank 12 (FIG. 1) confining the electrolytic plating bath 10 (FIG. 1) and the substrate 50 is immersed in the hexahydroxy-platinate [$H_2Pt(OH)_6$] electrolytic solution 13, at a temperature of about 45° C. to about 75° C., more preferably of about 65° C. In an exemplary embodiment of the invention, the substrate 50 is immersed in the hexahydroxy-platinate [$H_2Pt(OH)_6$] electrolytic solution for about 2 minutes to about 4 minutes, more preferably for about 3 minutes. As explained above, a percentage of the hexahydroxy-platinate [$H_2Pt(OH)_6$] electrolytic solution is fed through the filter 30 (FIG. 2) into the oxidizing tower 100 (FIG. 2), which in a preferred embodiment, comprises 30% peroxide ($H_2O_2$) at a temperature of about 60° C. to about 80° C., more preferably at about 65° C. Reoxidation and in-situ recovery of the $Pt^{+2}$ ions takes place in the oxidizing tank 40 (FIG. 3), as $Pt^{+2}$ ions are converted to $Pt^{+4}$ ions according to equation (3) outlined above.

Figure 6:
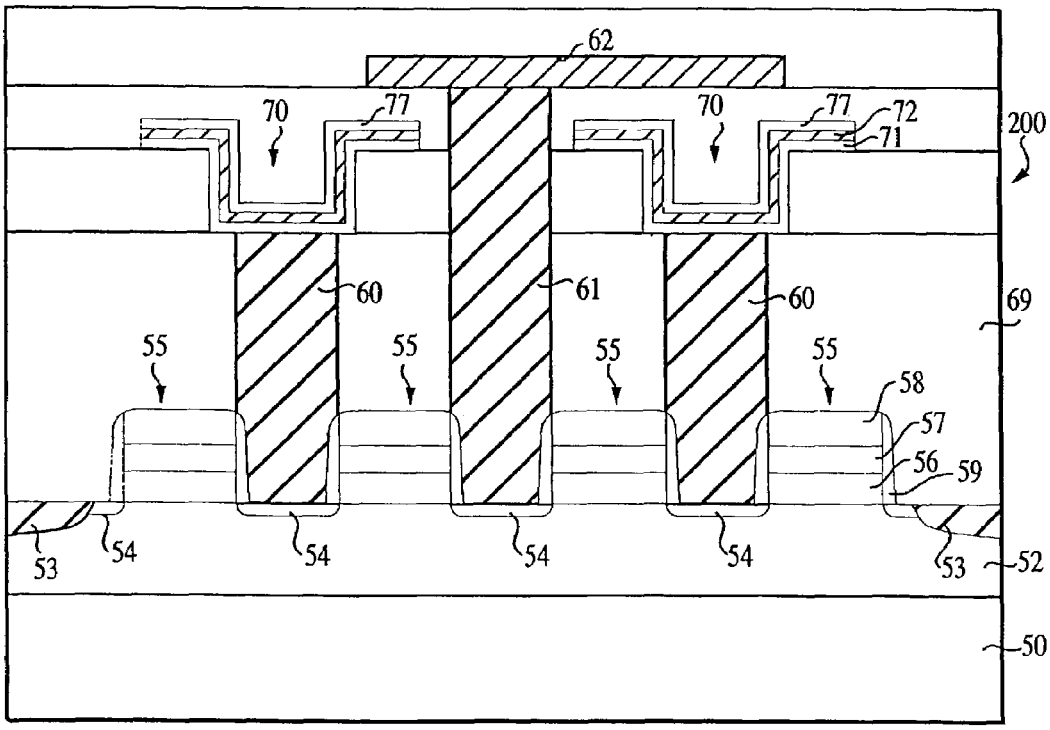
FIG. 6 illustrates a schematic cross-sectional view of the memory device of FIG. 5 at a stage of processing subsequent to that shown in FIG. 5.

Although FIG. 6 shows the platinum layer 77 as a patterned upper capacitor plate, those skilled in the art will realize that the platinum layer 77 formed by the low current density electroplating method of the present invention is initially formed as a blanket-deposited layer over the dielectric film 72 and then both the platinum layer and the dielectric film 72 are patterned and etched according to known methods of the art to obtain the capacitor structure of FIG. 6.

Although the invention has been described with reference to the formation of an upper platinum plate of an MIM capacitor, the invention is not limited to the above embodiments. Thus, the invention contemplates the electroplating at low current densities and the formation of high quality platinum films with good step coverage that can be used in a variety of IC structures, for example as seed layers, conductors, fuse elements, or electrolytic beds, among many others.

The above description illustrates preferred embodiments that achieve the features and advantages of the present invention. It is not intended that the present invention be limited to the illustrated embodiments. Modifications and substitutions to specific process conditions and structures can be made without departing from the spirit and scope of the present invention. Accordingly, the invention is not to be considered as being limited by the foregoing description and drawings, but is only limited by the scope of the appended claims.

What is claimed as new and desired to be protected by Letters Patent of the United States is:

1. An electrolytic system comprising:

an electroplating bath containing a platinum electroplating solution for electroplating a semiconductor wafer;

an electrical circuit for applying an electrical current with a current density of less than 5 mA/$cm^2$ and an electrical potential across said platinum electroplating solution, said electrical circuit including an electrode, said electrical potential generating $Pt^{+2}$ ions in said platinum electroplating solution;

an oxidizing unit with a peroxide solution at a temperature of about 60 C to about 80 C, said oxidizing unit being configured to receive about 10% to about 15% of said platinum electroplating solution and to decrease a concentration of said $Pt^{+2}$ ions of said platinum electroplating solution, said oxidizing unit being part of a closed loop recirculation system for platinum; and a conduit for connecting said oxidizing unit to said electroplating bath.

2. The electrolytic system of claim 1 further comprising a sensor for monitoring the change in concentration of said $Pt^{+2}$ ions.

3. The electrolytic system of claim 2, wherein said sensor is a galvanic cell.

4. The electrolytic system of claim 2, wherein said sensor is part of a feedback loop which controls said concentration of $Pt^{+2}$ ions in said electroplating solution.

5. The electrolytic system of claim 1, wherein said platinum electroplating solution is an alkaline solution.

6. The electrolytic system of claim 1, wherein said platinum electroplating solution is a hexahydroxy-platinate [$H_2Pt(OH)_6$] solution.

7. The electrolytic system of claim 6, wherein said platinum electroplating solution comprises hexahydroxy-platinate [$H_2Pt(OH)_6$] and a base.

8. The electrolytic system of claim 1, wherein said oxidizing unit is a batch oxidizing tower.

9. The electrolytic system of claim 1, wherein said oxidizing unit is a CSTR oxidizing tower.

10. The electrolytic system of claim 1, wherein said peroxide solution is a 30% peroxide solution.

11. The electrolytic system of claim 1, wherein said oxidizing solution is a 30% peroxide solution at a temperature of about 65 C.

12. An electrolytic bath in communication with an oxidizing tower for platinum electroplating a semiconductor device, said platinum electrolytic bath comprising:

a platinum electroplating solution in said electrolytic bath;

a semiconductor device provided within said platinum electroplating solution;

an electrical circuit for applying an electrical current with a current density of less than 5 mA/cm$^2$ and an electrical potential across said platinum electroplating solution, said electrical circuit including an electrode, said electrical potential generating $Pt^{+2}$ ions in said platinum electroplating solution;

an oxidizing solution in said oxidizing tower for decreasing a first concentration of $Pt^{+2}$ ions from at least a part of said platinum electroplating solution to a second concentration of $Pt^{+2}$ ions, said at least part of said platinum electroplating solution being removed from said electrolytic bath to said oxidizing tower; and a sensor in communication with said oxidation tower, said sensor being part of a feedback loop.

13. The electrolytic bath of claim 12, wherein said platinum electroplating solution comprises hexahydroxy-platinate [$H_2Pt(OH)_6$] and a base.

14. The electrolytic bath of claim 12, wherein said oxidizing solution comprises peroxide.

15. The electrolytic bath of claim 14, wherein said oxidizing solution is a 30% peroxide solution at a temperature of about 60 C to about 80 C.

16. The electrolytic bath of claim 12, wherein said oxidizing tower is a batch oxidizing tower.

17. The electrolytic bath of claim 12, wherein said oxidizing tower is a CSTR oxidizing tower.

18. The electrolytic bath of claim 12, wherein said sensor is configured to detect the concentrations of said $Pt^{+2}$ ions of said platinum electroplating solution.

19. The electrolytic bath of claim 18, wherein said sensor is a galvanic cell.

20. An oxidizing system for oxidizing $Pt^{+2}$ ions to $Pt^{+4}$ ions, said system comprising an electrolytic bath, said electrolytic bath comprising:

a platinum electroplating solution, at least part of said platinum electroplating solution comprising said $Pt^{+2}$ ions;

a semiconductor wafer immersed in said platinum electroplating solution;

an oxidizing apparatus configured to receive about 10% to about 15% of said at least part of said platinum electroplating solution for oxidizing said $Pt^{+2}$ ions from said at least part of said platinum electroplating solution to said $Pt^{+4}$ ions;

a first conduit for connecting said oxidizing apparatus to said platinum electroplating solution;

a sensor for monitoring the change in concentration of said $Pt^{+2}$ ions, said sensor being part of a feedback loop which controls said concentration of said $Pt^{+2}$ ions in said electrolytic bath; and a second conduit for connecting said oxidizing apparatus to said sensor.

21. The oxidizing system of claim 20, wherein said platinum electroplating solution comprises hexahydroxy-platinate and a base.

22. The oxidizing system of claim 20, wherein said oxidizing apparatus comprises an oxidizing tower with an oxidizing solution.

23. The oxidizing system of claim 22, wherein said oxidizing tower is a batch oxidizing tower.

24. The oxidizing system of claim 22, wherein said oxidizing tower is a CSTR oxidizing tower.

25. The oxidizing system of claim 22, wherein said oxidizing solution comprises peroxide.

26. The oxidizing system of claim 20, wherein said sensor is a galvanic cell.

* * * * *

UNITED STATES PATENT AND TRADEMARK OFFICE

CERTIFICATE OF CORRECTION

PATENT NO. : 7,476,305 B2
APPLICATION NO. : 10/382871
DATED : January 13, 2009
INVENTOR(S) : Chopra It is certified that error appears in the above-identified patent and that said Letters Patent is hereby corrected as shown below:

In column 8, line 34, In Claim 1, delete "60 C to about 80 C," and insert -- 60° C. to about 80° C., --, therefor.

In column 8, line 67, in Claim 11, delete "65 C." and insert -- 65° C. --, therefor.

In column 9, line 28, in Claim 15, delete "60 C to about 80 C." and insert -- 60° C. to about 80° C. --, therefor.

In column 10, line 24, in Claim 21, before "and" insert -- $[H_2Pt(OH)_6]$ --.

Signed and Sealed this

Thirty-first Day of March, 2009

JOHN DOLL
*Acting Director of the United States Patent and Trademark Office*